US011930982B2

(12) United States Patent
Rauber

(10) Patent No.: US 11,930,982 B2
(45) Date of Patent: Mar. 19, 2024

(54) DISHWASHER FOR USE IN A MEANS OF TRANSPORT

(71) Applicant: MEIKO Maschinenbau Gmbh & Co. KG, Offenburg (DE)

(72) Inventor: Hans-Josef Rauber, Oberhamersbach (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 64 days.

(21) Appl. No.: 17/595,284

(22) PCT Filed: May 13, 2020

(86) PCT No.: PCT/EP2020/063280
§ 371 (c)(1),
(2) Date: Nov. 12, 2021

(87) PCT Pub. No.: WO2020/229514
PCT Pub. Date: Nov. 19, 2020

(65) Prior Publication Data

US 2022/0313060 A1 Oct. 6, 2022

(30) Foreign Application Priority Data

May 14, 2019 (DE) ..... 102019206978.9

(51) Int. Cl.
*A47L 15/00* (2006.01)
*A47L 15/42* (2006.01)

(52) U.S. Cl.
CPC ..... *A47L 15/4244* (2013.01); *A47L 15/0023* (2013.01); *A47L 15/0049* (2013.01);
(Continued)

(58) Field of Classification Search
CPC ..... A47L 15/00–508; D06F 1/00–95/008
See application file for complete search history.

(56) References Cited

U.S. PATENT DOCUMENTS 6,654,975 B2 12/2003 Broker
9,096,966 B2 8/2015 Kaltofen
(Continued)

FOREIGN PATENT DOCUMENTS

DE 102004056052 A1 6/2006
DE 102007025263 A1 10/2007
(Continued)

OTHER PUBLICATIONS

PCT, Int. App. No. PCT/EP2020/063280 International Search Report (translated) and Written Opinion, 16 pages, dated Jul. 10, 2020.
(Continued)

*Primary Examiner* — Mikhail Kornakov
*Assistant Examiner* — Richard Z. Zhang
(74) *Attorney, Agent, or Firm* — Woodard, Emhardt, Henry, Reeves & Wagner, LLP

(57) ABSTRACT

The invention relates to a dishwasher (110) for use in a means of transport (114) The dishwasher comprises a) at least one cleaning chamber (122) for receiving an item (112) to be cleaned, b) at least one application device (130) for applying the item (112) to be cleaned in the cleaning chamber (122) with at least one cleaning fluid (126): c) at least one washing tank (128) for receiving the at least one cleaning fluid (126), wherein the dishwasher (110) is designed to control a fill level of the washing tank (128) with the cleaning fluid (126) to a variably adjustable target level; d) at least one receiving device (186) for receiving at least one item of spatial information relating to the dishwasher (110); and e) at least one controller (166), wherein the controller (166) is programmed to determine the target level according to the spatial information.

24 Claims, 2 Drawing Sheets

(52) U.S. Cl.
CPC ..... *A47L 15/0063* (2013.01); *A47L 15/0076* (2013.01); *A47L 2401/34* (2013.01); *A47L 2501/01* (2013.01); *A47L 2501/02* (2013.01)

(56) References Cited

U.S. PATENT DOCUMENTS

| | | | |
|---|---|---|---|
| 11,112,291 | B2 | 9/2021 | Phillip |
| 2003/0037383 | A1 | 2/2003 | Broker |
| 2009/0183753 | A1 | 7/2009 | Maennle et al. |
| 2010/0132735 | A1 | 6/2010 | Gaus et al. |
| 2017/0049293 | A1 | 2/2017 | Haas et al. |

FOREIGN PATENT DOCUMENTS

| | | | | |
|---|---|---|---|---|
| DE | 102008028304 | A1 | | 12/2009 |
| DE | 102009028460 | A1 | | 2/2011 |
| DE | 102016218001 | A1 | | 3/2018 |
| DE | 102017005626 | A1 | | 12/2018 |
| EP | 3142924 | A1 | | 3/2017 |
| JP | H01207029 | | * | 8/1989 |
| JP | H01207029 | A | * | 8/1989 |
| JP | H01207029 | A | | 8/1989 |
| JP | 2003275703 | A | | 9/2003 |
| JP | 5516234 | B2 | | 6/2014 |
| KR | 101888418 | B1 | | 8/2018 |
| RU | 194282 | U1 | | 12/2019 |
| WO | 2009152048 | A1 | | 12/2009 |

OTHER PUBLICATIONS

PCT, Int. App. No. PCT/EP2020/063280 International Preliminary Report on Patentability (translated), dated Nov. 16, 2021.
Human Translation of JPH01207029A to Morishige, 11 pages, Aug. 21, 1989.

* cited by examiner

DISHWASHER FOR USE IN A MEANS OF TRANSPORT

TECHNICAL FIELD

The invention relates to a dishwasher for use in a means of transport, to a means of transport, to a method for operating a dishwasher, to a computer program for use in a controller of a dishwasher and to a use of the proposed dishwasher for use in a means of transport. Dishwashers and methods of the type mentioned may be used for example in the area of commercial dishwashing. Thus, the invention may be used in particular in commercial single-chamber dishwashers, such as for example batch dishwashers or else in pass-through dishwashers. The invention is suitable in principle for use in numerous means of transport, in particular for use in on-board restaurants or rail lounge cars, for use in aircraft, for use in overland buses or else for use in galleys on ships. Other areas of use are however also possible in principle.

TECHNICAL BACKGROUND

The prior art discloses many cleaning devices, also referred to as cleaning appliances, that can clean and/or disinfect items to be cleaned. The overall configuration of these cleaning devices depends greatly on the various boundary conditions, such as for example the type of items to be cleaned, the contamination, the throughput or similar conditions. By way of example, reference can be made to cleaning devices that are described for example in DE 10 2004 056 052 A1 or in DE 10 2007 025 263 A1.

Cleaning devices of the type mentioned usually have at least one application device for applying at least one cleaning fluid to the items to be cleaned. For example, a nozzle system, in particular a washing system with one or more nozzles, may be provided, in order to apply one or more cleaning fluids, such as for example liquids and/or steam, to the items to be cleaned. Application generally takes place in circulating mode, from at least one washing tank, for example from a washing tank configured as open toward a cleaning chamber or just separated by a screen. In addition, in particular in the case of commercial dishwashers, at least one rinsing tank may also be provided, also referred to as the final-rinsing tank, in which rinsing fluid can be prepared independently of the cleaning fluid in the washing tank in order to shorten a cleaning time. Also generally provided is at least one controller, which activates one or more functions of the cleaning device, such as for example one or more pumps, one or more heaters, one or more valves or else entire groups of functions and their time sequence, including entire cleaning programs.

In particular, dishwashers are often not operated in a stationary state, but are for example used in galleys of mobile means of transport. In this case, however, there is the technical challenge of having to prevent overflowing of the cleaning liquid from the washing tank, for example in the case of accelerations, braking maneuvers, cornering, traveling over uphill or downhill gradients, turbulence or else fluctuations caused by swell. Mechanical constructions for providing protection from overflowing or generally for safeguarding against swell are generally known in particular from nautical technology. In particular, by analogy with fiddles for guarding against swell, raised overflow edges may be provided on the tank in order to avoid running out of the contents of the tank even when there are fluctuations US 2003/0 037 383 A1 describes an appliance with a display system in connection with leveling the appliance. The system includes an accelerometer, which is used in connection with an electronic controller to sense the degree to which the appliance is not level. The signals from the accelerometer are sent to a CPU, which controls a visual depiction on a display provided on the appliance. Adjustments made to alter the leveling condition of the appliance are also relayed to the CPU, thereby updating the display and conveying when the appliance is suitably level.

However, such structural measures have associated disadvantages in practice. For example, increasing the height of one or more edges of the washing tank when there is a prescribed installation size of the dishwasher reduces a useful height of the interior space of the dishwasher. Moreover, structural measures generally involve completely changing the type of machine, since such alterations have to be taken into account already very early in the basic construction of the dishwasher. It must also be taken into account here that dishwashers for use in means of transport are generally produced in comparatively small numbers, and so a custom design that changes the basic construction of the dishwasher in comparison with conventional stationary dishwashers would often be uneconomical in practice.

Problem Addressed by the Invention

It would therefore be desirable to provide a dishwasher and a method for operating the same that are suitable in particular for use in means of transport and at least largely avoid the disadvantages of known dishwashers and methods of the type mentioned. In particular, effective protection from overflowing of a washing tank of the dishwasher should be ensured and be effective even in cases of strong acceleration as a result for example of braking or accelerating operations, sharp cornering or great tilting or even when great fluctuations are caused for example by turbulence or swell.

GENERAL DESCRIPTION OF THE INVENTION

This problem is addressed by a dishwasher for use in a means of transport, a means of transport, a method for operating a dishwasher, a computer program for use in a controller of a dishwasher and a use of the proposed dishwasher for use in a means of transport, with the features of the independent patent claims. Advantageous developments, which can be realized individually or in any desired combination, are presented in the dependent claims.

In the text which follows, the terms "exhibit", "have", "comprise" or "include" or any grammatical departures therefrom are used non-exclusively. Accordingly, these terms can refer both to situations in which, apart from the features introduced by these terms, no further features are present, and to situations in which one or more further features are present. For example, the expression "A exhibits B", "A has B", "A comprises B" or "A includes B" may refer both to the situation in which, apart from B, no further element is present in A (i.e. to a situation in which A exclusively consists of B), and to the situation in which, in addition to B, one or more further elements are present in A, for example element C, elements C and D or even further elements.

Furthermore, it should be noted that the terms "at least one" and "one or more" and grammatical modifications of these terms, if they are used in association with one or more elements or features and are intended to express the fact that the element or feature can be provided singly or multiply, generally are used only once, for example when the feature or element is introduced for the first time. When the feature or element is subsequently mentioned again, the corresponding term "at least one" or "one or more" is generally no longer used, without restricting the possibility that the feature or element may be provided singly or multiply.

Furthermore, in the text which follows, the terms "preferably", "in particular", "for example" or similar terms are used in conjunction with optional features, without alternative embodiments being restricted thereby. Thus, features which are introduced by these terms are optional features, and the scope of protection of the claims, and in particular of the independent claims, is not intended to be restricted by these features. Thus, as a person skilled in the art will appreciate, the invention can also be carried out using other configurations. In a similar way, features which are introduced by "in one embodiment of the invention" or by "in one exemplary embodiment of the invention" are understood as optional features, without alternative configurations or the scope of protection of the independent claims being intended to be restricted thereby. Furthermore, all possibilities of combining the features introduced by these introductory expressions with other features, be they optional or non-optional features, are intended to remain unaffected by these introductory expressions.

In a first aspect of the present invention, a dishwasher for use in a means of transport is proposed, and a means of transport, comprising the dishwasher. The term "dishwasher", as it is used here, is a broad term which is to be taken to have its customary and commonly used meaning as it is understood by a person skilled in the art. The term is not restricted to a specific or adapted meaning. The term may, without restriction, refer in particular to a cleaning device which is designed to remove at least to a great extent adhering contaminants from items to be cleaned in the form of dishes and/or to sanitize and/or disinfect the dishes, in particular by applying at least one cleaning fluid. The dishes may in particular comprise items to be cleaned that are designed and intended for serving, preparing or keeping food and/or drink, for example items to be cleaned selected from the group consisting of: plates, cups, bowls, basins, glasses, cans, pots, trays, eating utensils, catering containers. The dishwasher may however also in principle be designed or used to clean other types of items to be cleaned, for example personal protective equipment such as for example respirators, breathing masks or similar articles. Other types of items to be cleaned are also possible in principle. As will be described in greater detail below, the dishwasher may be configured in particular as a batch dishwasher which is designed to perform at least one cleaning program on the items to be cleaned received in a cleaning chamber, with cleaning fluid, for example cleaning liquid in the form of rinsing liquid and/or final-rinsing liquid, being applied to the items to be cleaned in at least one program step of the cleaning program.

The term "means of transport", as it is used here, is a broad term which is to be taken to have its customary and commonly used meaning as it is understood by a person skilled in the art. The term is not restricted to a specific or adapted meaning. The term may, without restriction, refer in particular to a vehicle or vessel or a mobile means of transport for transporting persons and/or freight, designed for use on land, water or in the air. Accordingly, the means of transport may comprise in particular at least one means of transport selected from the group consisting of: a motor vehicle, in particular an overland bus; a ship, in particular a passenger ship and/or a cargo ship; an aircraft, in particular a passenger aircraft, a railroad train or part thereof, in particular a rail car and in particular a dining car or a rail lounge car. Other areas of use are however also possible in principle.

The dishwasher comprises:

a) at least one cleaning chamber for receiving items to be cleaned;

b) at least one application device for applying at least one cleaning fluid to the items to be cleaned in the cleaning chamber;

c) at least one washing tank for receiving the at least one cleaning fluid, the dishwasher being designed to control a filling level of the washing tank with the cleaning fluid to a variably adjustable target level;

d) at least one receiving device for receiving at least one item of spatial information concerning the dishwasher; and e) at least one controller, the controller being programmed to determine the target level in accordance with the spatial information.

The term "items to be cleaned", as it is used here, is a broad term which is to be taken to have its customary and commonly used meaning as it is understood by a person skilled in the art. The term is not restricted to a specific or adapted meaning. The term may, without restriction, refer in particular to dishes in the sense of the above definition. In principle, however, cleaning of other types of items to be cleaned is also possible in the dishwasher.

The term "cleaning chamber", as it is used here, is a broad term which is to be taken to have its customary and commonly used meaning as it is understood by a person skilled in the art. The term is not restricted to a specific or adapted meaning. The term may, without restriction, refer in particular to a completely or partially closed chamber within which the operation of cleaning the dishes in the dishwasher can be completely or partially carried out. The dishwasher and/or the cleaning chamber may in particular have at least one housing, which entirely or partially encloses the cleaning chamber. A single cleaning chamber may be provided here, or else in principle a number of cleaning chambers may be provided, for example sequentially. In the present case, the dishwasher may be in particular a single-chamber dishwasher, with just one cleaning chamber. Generally, the cleaning chamber may for example have at least one opening for loading the cleaning chamber with the items to be cleaned. For example, this may be an opening with a flap arranged on a front side of the cleaning chamber and/or an upper side of the cleaning chamber. Alternatively, hoods for closing off the cleaning chamber are also possible, for example as provided in so-called hood-type dishwashers. Again, the cleaning chamber may alternatively also for example be configured completely or partially as a tunnel, for example as provided in so-called pass-through dishwashers.

The term "cleaning fluid", as it is used here, is a broad term which is to be taken to have its customary and commonly used meaning as it is understood by a person skilled in the art. The term is not restricted to a specific or adapted meaning. The term may, without restriction, refer in particular to a liquid which can produce a cleaning effect when it comes into contact with the items to be cleaned. Accordingly, without restricting the use of other fluidic media, in the text which follows the term "cleaning liquid" is also used instead of the term "cleaning fluid". In particular, the cleaning liquid may comprise an aqueous liquid, for example water and/or water with one or more additives, for example with one or more cleaner concentrates and/or rinse aids and/or disinfectants. The cleaning device may be designed to use a single cleaning liquid or else to use a combination of a number of cleaning liquids. If a number of cleaning liquids are provided, the various cleaning liquids may be applied to the items to be cleaned simultaneously or else sequentially. Thus, the items to be cleaned may for example remain stationary within the cleaning chamber and have the various cleaning liquids and/or cleaning fluids applied to them one after the other.

The term "application device", as it is used here, is a broad term which is to be taken to have its customary and commonly used meaning as it is understood by a person skilled in the art. The term is not restricted to a specific or adapted meaning. The term may, without restriction, refer in particular to any device in principle by means of which the at least one cleaning fluid, in particular the at least one cleaning liquid, can be applied to the items to be cleaned within the cleaning chamber. As will be explained in greater detail below, the application device may in particular comprise at least one nozzle system. Furthermore, the application device may comprise at least one pump, and at least one line system, for providing cleaning liquid to the nozzle system. In this case, for example a nozzle system and a line system may be provided for applying cleaning liquid from the washing tank, and at least one washing pump. Furthermore, at least one nozzle system and at least one line system may be provided for applying cleaning liquid from the rinsing and/or final-rinsing tank still to be described in greater detail below, and at least one final-rinsing pump. Examples will be explained in greater detail below.

The term "washing tank", as it is used here, is a broad term which is to be taken to have its customary and commonly used meaning as it is understood by a person skilled in the art. The term is not restricted to a specific or adapted meaning. The term may, without restriction, refer in particular to a storage container which is designed to receive the at least one cleaning liquid. In particular, it may be a container which is in direct fluidic connection with the cleaning chamber, for example in that the washing tank is formed and/or provided on the bottom or in the bottom of the cleaning chamber. For example, the washing tank may be open with respect to the cleaning chamber or just formed separately from the cleaning chamber for example by a screen or perforated plate. The latter possibilities of separation by a screen or a perforated plate are intended here to be synonymous with the possibility of an opening of the washing tank with respect to the cleaning chamber. For example, a funnel by way of which the cleaning fluid can flow away into the washing tank may be provided in the bottom of the cleaning chamber. The application device may for example be designed to apply cleaning fluid from the washing tank to the items to be cleaned in a circulating mode by means of a circulating pump.

As stated above, the dishwasher is designed to control a filling level of the washing tank with the cleaning fluid to a variably adjustable target level. For this purpose, the dishwasher may for example have at least one closed-loop or feedback controller, and for example at least one level sensor for sensing the level of the cleaning fluid in the washing tank steplessly or in steps and also at least one control device for influencing the level of the cleaning fluid in the washing tank, for example at least one pump and/or at least one valve. The feedback controller may for example be designed to activate the control device, for example by activation of the pump and/or activation of the valve, in order in this way, for example in accordance with at least one filling-level signal transmitted by the level sensor to the feedback controller, to replenish the washing tank with cleaning fluid if it falls below a target level and to let out cleaning fluid from the washing tank if it goes above the target level. For replenishing the cleaning fluid, for example fresh cleaning fluid, for example fresh water and/or cleaning fluid from at least one optional equalizing tank, may be fed to the washing tank by opening the at least one valve and/or by correspondingly activating the at least one pump. For letting out cleaning fluid from the washing tank, for example cleaning fluid may be let out of it into an outflow and/or into the optional equalizing tank, for example once again by opening at least one valve and/or by correspondingly activating the at least one pump. The at least one feedback controller may for example be entirely or partially configured as hardware, for example as an electronic feedback controller, and/or may be entirely or partially configured as software, for example as software which is installed and/or can run in at least one processor, for example at least one processor of the controller of the dishwasher described in greater detail below. The feedback controller may consequently also be entirely or partially integrated in the controller of the dishwasher described in greater detail below.

The term "target level", as it is used here, is a broad term which is to be taken to have its customary and commonly used meaning as it is understood by a person skilled in the art. The term is not restricted to a specific or adapted meaning. The term may, without restriction, refer in particular to a level of the cleaning fluid in the washing tank, that is to say to a filling level of the washing tank that is to be aimed for by corresponding feedback control. The target level may therefore be in particular the setpoint value of the feedback control of the level of the cleaning fluid in the washing tank.

The term "variably adjustable", as it is used here, is a broad term which is to be taken to have its customary and commonly used meaning as it is understood by a person skilled in the art. The term is not restricted to a specific or adapted meaning. The term may, without restriction, refer in particular to the fact that the target level may be adjusted to at least two, preferably to at least three, four or more different values, for example steplessly or else in steps. For example, a discrete or continuous range of values of possible target levels may be prescribed, the machine being designed to adjust the level of the cleaning fluid in the washing tank to these values.

The term "receiving device", as it is used here, is a broad term which is to be taken to have its customary and commonly used meaning as it is understood by a person skilled in the art. The term is not restricted to a specific or adapted meaning. The term may, without restriction, refer in particular to a device entirely or partially configured as hardware and/or entirely or partially configured as software which is designed to generate the at least one item of spatial information and/or to receive the at least one item of spatial information from another device, so that it is available to the controller. The receiving device may also be entirely or partially integrated in the controller.

The term "spatial information", as it is used here, is likewise a broad term which is to be taken to have its customary and commonly used meaning as it is understood by a person skilled in the art. The term is not restricted to a specific or adapted meaning. The term may, without restriction, refer in particular to any desired information which describes a location of the dishwasher, a spatial orientation of the dishwasher, a change over time of the location of the dishwasher or a change over time of the spatial orientation of the dishwasher, an acceleration or deceleration of the dishwasher, an angular acceleration of the orientation of the dishwasher or a combination of the possibilities mentioned. The information may in particular be made available in a digital or analog form. In particular, as will be described in greater detail below, the information may for example be transmitted to the receiving device by way of at least one sensor integrated in the dishwasher, by way of at least one external sensor or by way of at least one external information transmitter.

As stated above, the dishwasher also comprises at least one controller which is programmed to determine the target level in accordance with the spatial information. This may mean in particular that the controller is designed to fix the target level, which in principle can for example be freely selected within a possible range of values, to a specific value in accordance with the spatial information.

The term "controller", as it is used here, is a broad term which is to be taken to have its customary and commonly used meaning as it is understood by a person skilled in the art. The term is not restricted to a specific or adapted meaning. The term may, without restriction, refer in particular to a one-part or multi-part device of the dishwasher which is designed to completely or partially control operation of the dishwasher in an open-loop or closed-loop, or feedback, manner. In particular, the controller may be designed to change, in particular control, one or more operating parameters of the dishwasher, for example at least one temperature, at least one pressure, at least one pump output, at least one valve position, at least one heating output or else a combination of two or more of the operating parameters mentioned. The controller may in particular comprise at least one data processing device, for example at least one processor. The controller may in particular be programmed for example to control or carry out at least one cleaning program of the dishwasher. Accordingly, the controller device may be partially realized by hardware and/or, alternatively or additionally, completely or partially realized by software. Furthermore, the controller may comprise at least one volatile and/or nonvolatile data store. Furthermore, the controller may comprise at least one interface, for example a man-machine interface for the input of commands and/or the output of items of information, and/or a wireless or wired-bound interface for the unidirectional or bidirectional exchange of data and/or commands between the dishwasher and at least one further device. The controller may in particular comprise at least one computer and/or at least one processor. The controller may in particular be a centralized or decentralized machine controller of the dishwasher.

The term "programmed", as it is used here, is a broad term which is to be taken to have its customary and commonly used meaning as it is understood by a person skilled in the art. The term is not restricted to a specific or adapted meaning. The term may, without restriction, refer in particular to a property or device of the controller in which the controller is designed to carry out specific method steps by a software program permanently implemented in the controller and/or by a software program stored in a volatile or nonvolatile data store connected to the controller.

The controller is programmed to determine the target level in accordance with the spatial information. This may mean in particular that the controller is designed to select from the range of possible values of target levels a specific target level, which is then used in method step c), for controlling the level of the cleaning fluid in the washing tank. The selection is made in accordance with the spatial information, that is to say while taking into account the spatial information. This may for example take place by the controller being programmed to allow the at least one item of spatial information to be entered as an input variable or as one of a number of input variables into a determination process, for example a determination algorithm, which determines the target level to be used. For example, the controller may be programmed to compare the at least one item of spatial information with a plurality of prescribed items of spatial information or with ranges of values for items of spatial information and to make the selection of the target level in accordance with this comparison. Thus, individual values or else ranges of values for the spatial information may for example be provided in the controller, for example in at least one database and/or in at least one list, the controller being designed to compare whether the spatial information coincides with one of the individual values, for example also in the range of prescribed tolerances, and/or whether the spatial information falls into one or more of the prescribed ranges of values. For example, target levels corresponding to the individual values and/or ranges of values may be stored in the controller, so that the target level can then be chosen in accordance with the comparison. Again, alternatively or additionally, at least one algorithm which is designed to convert the spatial information into a corresponding target level may also be stored in the controller. The algorithm may for example also be configured as a self-learning algorithm. Thus, for example, in particular in the case of means of transport that often travel over the same routes, such as for example trains, overland buses, ships or aircraft, a self-learning algorithm may be used, for example an algorithm using at least one neural network, which assigns a target level to the spatial information. The algorithm may for example learn during various test runs. Generally, the controller may therefore be designed for example to determine the target level in accordance with the spatial information by using at least one self-learning algorithm, in particular by using at least one artificial intelligence and/or at least one neural network.

The controller may for example pass on the selected target level directly or indirectly to the feedback controller in the form of an electronic signal, for example in the form of a digital value and/or in the form of an analog electrical signal. As stated above, the feedback controller may however also be entirely or partially integrated in the controller.

As stated above, the washing tank may in particular be open toward the cleaning chamber, in order to make an exchange of liquid possible between the washing tank and the cleaning chamber. In particular, the washing tank may be provided in a bottom of the cleaning chamber and may for example be connected to the cleaning chamber by way of a funnel. A raised wall of the washing tank, for example in the form of an upwardly projecting edge, is not required, so that the dishwasher can be formed without such a raised edge of the washing tank. The washing tank may for example have at least one heating device, for example at least one heating coil.

The application device may for example have at least one nozzle system. The term "nozzle system", as it is used here, is a broad term which is to be taken to have its customary and commonly used meaning as it is understood by a person skilled in the art. The term is not restricted to a specific or adapted meaning. The term may, without restriction, refer in particular to a device or a combination of a number of devices which has or have one or more nozzles. In this case, a nozzle may be understood as meaning in particular an opening or a device with at least one opening from which the cleaning liquid can emerge. For example, the nozzle system may comprise at least one nozzle arm, which for example may be pivotably mounted. For example, the application device may have at least one washing nozzle system for applying cleaning liquid from the washing tank to the items to be cleaned. Furthermore, the application device may optionally have at least one final-rinsing nozzle system, also referred to as the rinsing nozzle system, for applying cleaning liquid from an optional final-rinsing tank, also referred to as the rinsing tank, to the items to be cleaned. The washing nozzle system and the optional final-rinsing nozzle system may respectively comprise for example at least one nozzle arm, preferably at least two nozzle arms, for example respectively at least one nozzle arm above the items to be cleaned and at least one nozzle arm below the items to be cleaned.

The items to be cleaned may for example be received in at least one cleaning rack in the cleaning chamber, so that the nozzle arms can for example be arranged, for example pivotably, above and below the cleaning rack.

Generally, the nozzle system may therefore have for example at least one washing nozzle system, in particular with at least one nozzle arm, in particular with at least one nozzle arm above the items to be cleaned and at least one nozzle arm below the items to be cleaned. The application device may also have at least one circulating pump and at least one washing line system, it being possible for example for cleaning liquid from the washing tank to be applied to the items to be cleaned in circulating mode by way of the washing line system and the circulating pump. The washing nozzle system described above, which is preferably formed separately from an optional final-rinsing nozzle system, may for example be used for this.

The optional final-rinsing tank or rinsing tank may in particular be entirely or partially formed as a boiler. The boiler may in particular be entirely or partially formed as a closed tank, in which optionally at least one second heating device may be arranged.

As described above, the application device may in particular have at least one final-rinsing nozzle system, in particular with at least one nozzle arm, in particular with at least one nozzle arm above the items to be cleaned and at least one nozzle arm below the items to be cleaned. The final-rinsing nozzle system may in particular be formed separately from the washing nozzle system. The application device may also have at least one final-rinsing pump and at least one final-rinsing line system, it being possible for cleaning liquid from the final-rinsing tank to be applied to the items to be cleaned by way of the final-rinsing line system and the final-rinsing pump.

The application device may in particular have at least one circulating pump. Accordingly, as stated above, the application device may in particular be designed to apply cleaning fluid from the washing tank to the items to be cleaned in the cleaning chamber in circulating mode.

The spatial information may generally comprise at least one item of information which can have an effect on a position and/or orientation of a liquid level in the washing tank. In particular, the spatial information may have at least one item of information selected from the group consisting of: an item of location information concerning a location of the dishwasher; an item of position information concerning a spatial alignment of the dishwasher; an item of movement information concerning a movement of the dishwasher; an item of acceleration information concerning an acceleration of the dishwasher; an item of topographical information concerning a topography of the location of the dishwasher; an item of change information concerning a change to be expected of at least one item of information selected from the group consisting of the item of location information, the item of position information, the item of movement information, the item of acceleration information and the item of topographical information. Thus, the at least one item of information may in particular also comprise an item of information concerning how a position, an orientation, a speed or an acceleration of the dishwasher will change within a prescribed time period in the future, for example a time period of 5 seconds to 2 minutes. For example, this change information may be derived from a known route traveled by the means of transport, for example in the case of rail vehicles or overland buses from an initiation of a braking operation or an accelerating operation, from an item of information concerning turbulence occurring, from an item of information concerning swell, an item of information concerning an imminent change of direction, an item of information concerning an imminent change of altitude, an item of information concerning a vehicle tilt or a combination of two or more of the possibilities mentioned.

As stated above, the controller may in particular be programmed to convert the spatial information into the target level by means of at least one conversion process. The conversion process may in particular be selected from the group consisting of: application of an assignment algorithm, the spatial information being assigned the corresponding target level by means of the assignment algorithm; referral to an electronic table, in which items of spatial information are respectively assigned corresponding target-level values; a self-learning algorithm. Further possibilities have already been described above.

Possible further configurations concern the receiving device. Thus, as stated above, generally the receiving device may have at least one electronic interface for receiving the spatial information. The at least one electronic interface may in particular have at least one wire-bound interface, for example at least one LAN interface. Alternatively or additionally, the at least one electronic interface may also have at least one wireless interface, in particular at least one WLAN interface.

The receiving device may be designed to receive the at least one item of spatial information completely or partially from at least one device and/or at least one information transmitter outside the dishwasher, for example a computer, a computer network, an external transmitter or else for example a central controller of the means of transport. Alternatively or additionally, the dishwasher and/or the receiving device may however also be entirely or partially designed to generate the at least one item of spatial information completely or partially independently. Thus, the receiving device may for example comprise at least one sensor for sensing the spatial information, it being possible for the at least one item of spatial information to be completely or partially generated or sensed by the at least one sensor. The at least one sensor may for example be arranged inside or else outside the housing of the dishwasher. The at least one sensor may in particular be selected from the group consisting of: a GPS sensor, a tilt sensor; an acceleration sensor; a pressure sensor; a triangulation sensor. The at least one item of spatial information may for example be derived directly or indirectly from sensor data of the at least one sensor. For example, sensor data of a GPS sensor of the controller may be used to carry out a comparison with a map and to derive from it, for example in the case of a route network or road network, an immediately imminent change of direction, accelerations or decelerations or other items of information that can directly or indirectly have an effect on an orientation of the liquid level of the cleaning fluid in the washing tank. Thus, for example, by comparison with a map, items of location information may provide information on whether a station will soon be approached, with an associated braking operation, whether there is cornering ahead, whether there is an uphill or downhill gradient ahead, whether a takeoff or landing procedure is about to take place, whether there is a tailback of vehicles ahead with a correspondingly enforced braking operation, or a combination of two or more of these items of information.

Generally, the controller may for example have at least one digitized map with a plurality of possible locations at which the dishwasher may be located. This may be for example a route network map, a road map or in principle any desired map, for example a topographical map. In the digitized map there may for example be at least one target level respectively stored in each case in relation to the possible locations. The storing may take place continuously or for example also discontinuously, in that for example the map or specific regions of this map, for example the routes and/or roads that can be traveled, are divided into sections or regions, with for example target levels being respectively stored in the regions. The target level may in each case be additionally dependent on at least one further parameter, in particular on a speed, for example an absolute speed or else a directed speed. Thus, the directed speed may for example provide an indication of when a specific change occurs, that is to say for example when specific cornering, travel over an uphill or downhill gradient, a braking operation or accelerating operation or other type of change will occur in the future. The digitized map may in particular be stored in a database of the controller. The digitized map may also be stored in a simple form, for example as a table, in particular as an electronic table, with for example an item of location information being assigned a target level.

As stated above, the level changing of the target level in the washing tank may take place in various ways. As also stated above, the dishwasher may in particular have at least one equalizing tank. The term "equalizing tank", as it is used here, is a broad term which is to be taken to have its customary and commonly used meaning as it is understood by a person skilled in the art. The term is not restricted to a specific or adapted meaning. The term may, without restriction, refer in particular to a container, preferably a container enclosed on all sides by a container wall, which is designed to receive cleaning fluid from the washing tank and/or to give off cleaning fluid to the washing tank. The equalizing tank may in particular be connected to the washing tank by way of at least one equalizing line. Furthermore, at least one equalizing valve may be connected to the equalizing line, and/or at least one equalizing pump may be provided, it being possible for a transfer of cleaning fluid from the washing tank into the equalizing tank or vice versa to be made possible and/or promoted by means of the equalizing valve and/or the equalizing pump. The equalizing pump and/or the equalizing valve may for example be activated by the controller and/or the optional feedback control. The controller may be designed to transfer part of the cleaning fluid from the washing tank into the equalizing tank when there is a lowering of the target level and/or the controller may be designed to transfer part of the cleaning fluid from the equalizing tank into the washing tank when there is a raising of the target level. As likewise stated, the possibility of the equalizing tank may optionally also be combined with other types of level changing, for example a drain into an outflow and/or a supply of fresh cleaning liquid, for example fresh water. The equalizing tank may in particular be thermally insulated. Alternatively or additionally, for example at least one heating device may also be provided in the equalizing tank, in order for example to make it possible to control the temperature of cleaning fluid in the equalizing tank. The equalizing tank may in particular have at least one level sensor for sensing the level in the equalizing tank, in particular for sensing a filling level of the equalizing tank with the cleaning fluid.

The equalizing tank may for example have a volume which corresponds as a maximum to the volume of the washing tank. For example, the equalizing tank may have a volume which corresponds to 10% to 90% of the volume of the washing tank. The equalizing tank may in particular be formed separately from the cleaning chamber, but may be fluidically connected to it, for example by way of the aforementioned at least one equalizing line. The equalizing tank may be connected to the washing tank by way of at least one pump, which may also be referred to as the equalizing pump, it being possible for example for the controller to be designed to activate the pump.

The dishwasher may also have at least one level sensor for sensing the filling level of the washing tank with the cleaning fluid. This may be for example a continuous or else discontinuous or discrete level sensor. Thus, for example, a level may be sensed steplessly or in steps. If sensing in steps is provided, the sensing may for example take place in at least 2, in particular in at least 3, at least 4 or even at least 5 steps.

The controller may in particular be designed to adjust the target level steplessly. However, adjustment in multiple stages is also possible for example. Thus, for example, specific discrete target levels may be respectively prescribed for specific regions of tilts, accelerations or vibrations and fluctuations to be expected.

As stated above, the dishwasher may in particular be designed as a dishwasher for commercial use. Accordingly, the dishwasher may for example also have in addition to the washing tank and optionally also in addition to the equalizing tank at least one rinsing tank, formed separately from the washing tank and optionally also separately from the at least one equalizing tank, for preparing at least one rinsing liquid. The rinsing tank is also referred to as the final-rinsing tank, and the rinsing liquid is also referred to as the final-rinsing liquid. For example, the rinsing tank may have at least one heating device. In particular, the rinsing tank may be formed as a boiler. A configuration for example as a continuous-flow heater or in combination with a continuous-flow heater is also possible.

The dishwasher may in particular be configured as a batch dishwasher. The controller may accordingly be programmed to perform at least one cleaning program, the cleaning program comprising at least one washing step in which the cleaning fluid from the washing tank is applied to the items to be cleaned, in particular in circulating mode. The controller may be designed to change the target level in the washing tank in accordance with the spatial information during the washing step.

The receiving device may in particular be designed to receive at least one item of type information concerning the type of the means of transport. The term "type information", as it is used here, is a broad term which is to be taken to have its customary and commonly used meaning as it is understood by a person skilled in the art. The term is not restricted to a specific or adapted meaning. The term may, without restriction, refer in particular to any type of information which comprises particulars about a type or configuration of the means of transport in which the dishwasher is used. The controller may in particular be designed to take the type information into account when determining the target level. Thus, the type information may for example comprise at least one item of information concerning how the means of transport itself reacts to specific spatial situations and/or to changes of the spatial situation. Accordingly, for example in the case of trains, the type information may comprise information concerning whether or not the train is equipped with tilting technology. Such information may for example be included in the determination of the target level, since for example in the case of trains with tilting technology the target level can usually be higher than in the case of trains without tilting technology, even on bends. Furthermore, the type information may for example also comprise information concerning at which point in the train the rail lounge car, the dining car or otherwise the location of the dishwasher lies. Such information may for example lead to the determination of a more accurate time sequence of specific changes of the position of the dishwasher, since for example sections of the train that are arranged nearer the end of the train reach specific bends later than sections of the train that are arranged further forward in the train. In the case of trains and also in the case of other means of transport, the type information may for example also provide information concerning behavior of the means of transport in specific situations to be expected, such as for example behavior of an aircraft when turbulence is to be expected or during takeoff, landing or banking. Thus, for example, larger commercial aircraft typically behave more stably and steadily in turbulence than smaller commercial aircraft, so that a target level can be chosen higher in the case of the former than in the case of the latter.

The receiving device may also be designed to receive at least one control signal from the means of transport. The term "control signal", as it is used here, is a broad term which is to be taken to have its customary and commonly used meaning as it is understood by a person skilled in the art. The term is not restricted to a specific or adapted meaning. The term may, without restriction, refer in particular to an electrical signal which is designed to provide items of control information to a controllable device. For example, this may be control information which specifies how certain operating parameters of the controllable device are to be adjusted. In the present case, the control signal may for example be a signal of an on-board computer of the means of transport. The controller of the dishwasher may in particular be designed to take the control signal into account when determining the target level. Thus, for example, an on-board computer of the means of transport may itself influence the target level.

In particular, the control signal may comprise at least one control signal for the means of transport itself. This may in particular involve the control signal being used at least in a dual function in the means of transport, to be specific on the one hand for controlling at least one function of the means of transport itself and on the other hand for controlling the dishwasher, and there in particular for influencing the target level. Thus, the control signal may in particular be selected from the group consisting of: a control signal for an acceleration of the means of transport; a control signal for a braking operation of the means of transport; a control signal for a change of position of the means of transport. Consequently, for example, a braking signal, which initiates a braking operation of the means of transport, may also be transmitted to the controller of the dishwasher, in order to be taken into account there for example to the extent that the target level is lowered in order to prevent overflowing of the washing tank in the braking operation that is about to take place. Alternatively or additionally, for example acceleration signals, steering signals, signals for ascending or descending, signals for turbulence ahead, signals from a pilot to the crew or passengers, or similar signals may also lead to lowering of the target level.

In a further aspect of the present invention, a method for operating the dishwasher according to the invention is proposed in one or more of the proposed configurations, for example according to any one or more of the embodiments described above and/or according to any one or more of the configurations still to be described in greater detail below. The method comprises the steps described in greater detail below. The steps may be carried out in particular in the stated sequence, although in principle a different sequence is also possible, or it is possible for the method steps to be carried out overlapping in time or else for one method step or a number of method steps to be carried out repeatedly. The method comprises the following steps:

i) receiving the at least one item of spatial information concerning the dishwasher by means of the receiving device;

ii) determining the target level in accordance with the spatial information by means of the controller; and iii) controlling the filling level of the washing tank with the cleaning fluid to the target level corresponding to the spatial information.

With respect to possible configurations of the individual method steps, reference can be made to the above description of the dishwasher.

The method may in particular be completely or partially computer-implemented. Consequently, also proposed for example within the scope of the present invention is a computer program which, when run on a computer or computer network, in particular when run on the controller, completely or partially performs the method according to the invention in one of its configurations, for example method step ii) and optionally also one or more of method steps i) and iii), it being possible for the latter to be carried out for example completely or partially as software-implemented by the computer program. The computer program may in particular comprise program code means, which may in particular be stored on at least one computer-readable data carrier. Also proposed is a data carrier, stored on which is a data structure which, after being loaded into a main memory of a computer or computer network, can completely or partially perform the method according to the invention in one of its configurations, for example method step ii) and optionally also one or more of method steps i) and iii), it being possible for the latter to be for example completely or partially software-implemented. Also proposed within the scope of the present invention is a computer program product with program code means stored on a machine-readable carrier in order to completely or partially carry out the method according to the invention in one of its configurations when the program is executed on a computer or computer network, for example method step ii) and optionally also one or more of method steps i) and iii), it being possible for the latter to be carried out for example completely or partially as software-implemented. A computer program product is understood here as meaning the program as a tradable product. It may in principle take any desired form, thus for example be on paper or a computer-readable data carrier, and may in particular be distributed over a data transmission network. Finally proposed is a modulated data signal, which contains instructions that can be carried out by a computer system or computer network for completely or partially performing the method according to the invention, for example method step ii) and optionally also one or more of method steps i) and iii), it being possible for the latter to be carried out for example completely or partially as software-implemented.

The computer program may in particular be designed specifically for use in the controller of the dishwasher proposed according to the invention, for example in one or more of the proposed configurations. The computer program may in particular comprise commands which bring about the effect that the controller determines the target level in accordance with the spatial information. Consequently, the computer program may therefore be designed in particular to carry out method step ii) and optionally also one or more of method steps i) and iii) as computer-implemented.

In a further aspect of the present invention, a use of the dishwasher proposed according the invention, for example in any one or more of the configurations described above and/or in any one or more of the configurations described in greater detail below, is proposed, for use in a means of transport, in particular a means of transport selected from the group consisting of: a railroad train, in particular a dining car of a railroad train; an overland bus; a ship; an aircraft; a mobile field kitchen. The means of transport may for example be in motion during the operation of the dishwasher, but may also for example be stationary, for example in a parking situation, in which the means of transport is level or inclined.

The proposed dishwasher, the proposed method, the proposed computer program and the proposed use have numerous advantages over known devices and methods of the type mentioned. In particular, the invention addresses the aforementioned technical challenges. Thus, unwanted overflowing of a washing tank can be avoided by adaptive feedback control of a level of the washing tank of a dishwasher in a means of transport, for example in situations during transport in which the means of transport, and consequently also the dishwasher, are subjected to strong tilt, acceleration, deceleration or fluctuations and vibrations. Such situations in which, without protective measures, the washing tank would overflow on one or more sides, for example as a result of tilting of the liquid level in relation to a plane of the dishwasher or as a result of fluctuations of the liquid level in relation to the plane of the dishwasher, can be alleviated technologically by an adaptation of a target level, for example by lowering the target level in time.

The invention may be used in particular in dishwashers in the form of automatic cleaning machines, in particular a commercial washer for dishes, glasses, kitchen utensils or similar items to be cleaned. As stated above, in principle other types of items to be cleaned can, however, also be cleaned in the dishwasher, for example parts of personal protective equipment such as for example breathing masks. In particular, the dishwasher may be a washer with a two-circuit system, in which at least one final-rinsing tank is provided in addition to the washing tank. Furthermore, the dishwasher may in particular be a washer with a stationary washing process, that is to say a dishwasher in which the items to be cleaned remain stationary in the cleaning chamber during the washing operation. In particular, it may be a batch dishwasher, in which the items to be cleaned are kept in a stationary state in the cleaning chamber during the cleaning operation, in which a two-circuit system is provided and in which the controller is designed to carry out at least one cleaning program. In principle, the dishwasher could, however, also be configured as a conveyor dishwasher. Generally, the present invention can be used in dishwashers in mobile use, while the means of transport is in motion. Examples are use in dining cars of railroad trains, in overland buses, on ships or in aircraft.

The dishwasher according to the invention also preferably does not need any significant structural modifications as compared with conventional dishwashers, since essentially an adaptation of the controller may be required. In particular, there is no need for structurally raising an edge of the washing tank, so that the proposed dishwasher can be produced at low cost and at the same time does not require structural measures that would increase an installation height of the dishwasher or reduce a usable space of the cleaning chamber. In principle, an adaptation of standard dishwashers that are not intended for use in means of transport is possible without any problem and at low cost.

To sum up, without restricting further possible configurations, the following embodiments are proposed:

Embodiment 1: A dishwasher for use in a means of transport, comprising:

a) at least one cleaning chamber for receiving items to be cleaned;

b) at least one application device for applying at least one cleaning fluid to the items to be cleaned in the cleaning chamber;

c) at least one washing tank for receiving the at least one cleaning fluid, the dishwasher being designed to control a filling level of the washing tank with the cleaning fluid to a variably adjustable target level;

d) at least one receiving device for receiving at least one item of spatial information concerning the dishwasher; and e) at least one controller, the controller being programmed to determine the target level in accordance with the spatial information.

Embodiment 2: The dishwasher according to the preceding embodiment, wherein the washing tank is open toward the cleaning chamber, in order to make an exchange of liquid possible between the washing tank and the cleaning chamber.

Embodiment 3: The dishwasher according to any one of the preceding embodiments, wherein the washing tank is formed in a bottom of the cleaning chamber.

Embodiment 4: The dishwasher according to any one of the preceding embodiments, wherein the washing tank has at least one heating device.

Embodiment 5: The dishwasher according to any one of the preceding embodiments, wherein the application device has at least one nozzle system.

Embodiment 6: The dishwasher according to any one of the preceding embodiments, wherein the application device has at least one circulating pump.

Embodiment 7: The dishwasher according to any one of the preceding embodiments, wherein the spatial information has at least one item of information selected from the group consisting of: an item of location information concerning a location of the dishwasher; an item of position information concerning a spatial alignment of the dishwasher; an item of movement information concerning a movement of the dishwasher; an item of acceleration information concerning an acceleration of the dishwasher; an item of topographical information concerning a topography of the location of the dishwasher; an item of change information concerning a change to be expected of at least one item of information selected from the group consisting of the item of location information, the item of position information, the item of movement information, the item of acceleration information and the item of topographical information.

Embodiment 8: The dishwasher according to any one of the preceding embodiments, wherein the controller is programmed to convert the spatial information into the target level by means of at least one conversion process, selected from the group consisting of: application of an assignment algorithm, the spatial information being assigned the corresponding target level by means of the assignment algorithm; referral to an electronic table, in which items of spatial information are respectively assigned corresponding target-level values; a self-learning algorithm.

Embodiment 9: The dishwasher according to any one of the preceding embodiments, wherein the receiving device has at least one electronic interface for receiving the spatial information, in particular at least one wire-bound interface, in particular at least one LAN interface, and/or at least one wireless interface, in particular at least one WLAN interface.

Embodiment 10: The dishwasher according to any one of the preceding embodiments, wherein the receiving device comprises at least one sensor for sensing the spatial information.

Embodiment 11: The dishwasher according to the preceding embodiment, wherein the sensor has at least one sensor, selected from the group consisting of: a GPS sensor; a tilt sensor; an acceleration sensor; a pressure sensor; a triangulation sensor.

Embodiment 12: The dishwasher according to any one of the preceding embodiments, wherein the controller has at least one digitized map with a plurality of possible locations at which the dishwasher may be located.

Embodiment 13: The dishwasher according to the preceding embodiment, wherein in the digitized map there is at least one target level respectively stored in each case in relation to the possible locations.

Embodiment 14: The dishwasher according to the preceding embodiment, wherein the target level is additionally dependent on at least one further parameter, in particular on a speed.

Embodiment 15: The dishwasher according to any one of the three preceding embodiments, wherein the digitized map is stored in a database of the controller.

Embodiment 16: The dishwasher according to any one of the preceding embodiments, wherein the dishwasher also has at least one equalizing tank, the controller being designed to transfer part of the cleaning fluid from the washing tank into the equalizing tank when there is a lowering of the target level and/or the controller also being designed to transfer part of the cleaning fluid from the equalizing tank into the washing tank when there is a raising of the target level.

Embodiment 17: The dishwasher according to the preceding embodiment, wherein the equalizing tank is thermally insulated.

Embodiment 18: The dishwasher according to any one of the two preceding embodiments, wherein the equalizing tank is formed separately from the cleaning chamber.

Embodiment 19: The dishwasher according to any one of the three preceding embodiments, wherein the equalizing tank is connected to the washing tank by way of at least one pump, the controller being designed to control the pump.

Embodiment 20: The dishwasher according to any one of the four preceding embodiments, wherein the equalizing tank also has at least one level sensor for sensing the filling level of the equalizing tank with the cleaning fluid.

Embodiment 21: The dishwasher according to any one of the preceding embodiments, wherein the dishwasher also has at least one level sensor for sensing the filling level of the washing tank with the cleaning fluid.

Embodiment 22: The dishwasher according to any one of the preceding embodiments, wherein the controller is designed to adjust the target level steplessly.

Embodiment 23: The dishwasher according to any one of the preceding embodiments, wherein the dishwasher also has at least one rinsing tank, formed separately from the washing tank, for preparing at least one rinsing liquid.

Embodiment 24: The dishwasher according to the preceding embodiment, wherein the rinsing tank has at least one heating device, in particular the rinsing tank being formed as a boiler.

Embodiment 25: The dishwasher according to any one of the preceding embodiments, wherein the dishwasher is designed as a batch dishwasher, the controller being programmed to perform at least one cleaning program, the cleaning program comprising at least one washing step in which the cleaning fluid from the washing tank is applied to the items to be cleaned, in particular in circulating mode, the controller being designed to change the target level in the washing tank in accordance with the spatial information during the washing step.

Embodiment 26: The dishwasher according to any one of the preceding embodiments, wherein the receiving device is also designed to receive at least one item of type information concerning the type of the means of transport, the controller being designed to take the type information into account when determining the target level.

Embodiment 27: The dishwasher according to any one of the preceding embodiments, wherein the receiving device is also designed to receive at least one control signal from the means of transport, the controller being designed to take the control signal into account when determining the target level.

Embodiment 28: The dishwasher according to the preceding embodiment, wherein the control signal comprises at least one control signal for the means of transport itself, the control signal being selected from the group consisting of: a control signal for an acceleration of the means of transport; a control signal for a braking operation of the means of transport; a control signal for a change of position of the means of transport.

Embodiment 29: The dishwasher according to any one of the preceding embodiments, wherein the controller is designed to determine the target level by using at least one self-learning algorithm.

Embodiment 30: A means of transport, comprising at least one dishwasher according to any one of the preceding embodiments.

Embodiment 31: A method for operating the dishwasher according to any one of the preceding embodiments concerning a dishwasher in a means of transport, comprising the following steps:

i) receiving the at least one item of spatial information concerning the dishwasher by means of the receiving device;
ii) determining the target level in accordance with the spatial information by means of the controller; and
iii) controlling the filling level of the washing tank with the cleaning fluid to the target level corresponding to the spatial information.

Embodiment 32: A computer program for use in a controller of a dishwasher according to any one of the preceding embodiments concerning a dishwasher, wherein the computer program comprises commands which bring about the effect that the controller determines the target level in accordance with the spatial information.

Embodiment 33: The use of a dishwasher according to any one of the preceding embodiments concerning a dishwasher in a means of transport, in particular a means of transport selected from the group consisting of: a railroad train, in particular a dining car of a railroad train; an overland bus; a ship; an aircraft; a mobile field kitchen.

BRIEF DESCRIPTION OF THE FIGURES

Further details and features may be found in the following description of exemplary embodiments, in particular in conjunction with the subclaims. The respective features may be implemented separately, or several of them may be implemented in combination with one another. The invention is not restricted to the exemplary embodiments. The exemplary embodiments are schematically represented in the figures. Designations which are the same in the individual figures denote elements which are the same or have the same function, i.e. they correspond to one another in respect of their functions.

Specifically.

DESCRIPTION OF THE EXEMPLARY EMBODIMENTS

Figure 1:
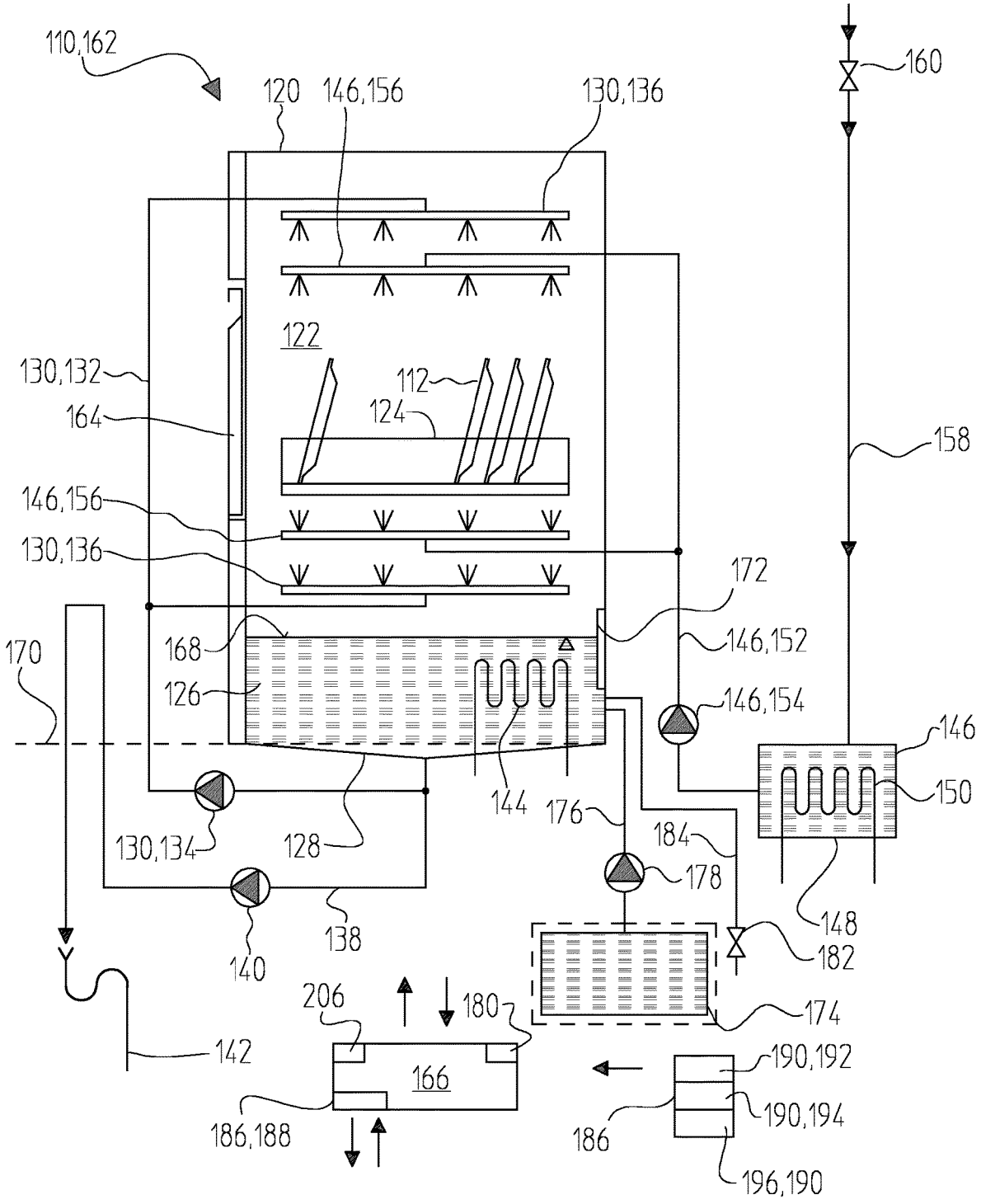
FIG. 1 shows an exemplary embodiment of a dishwasher in a sectional representation from the side.
Figure 2:
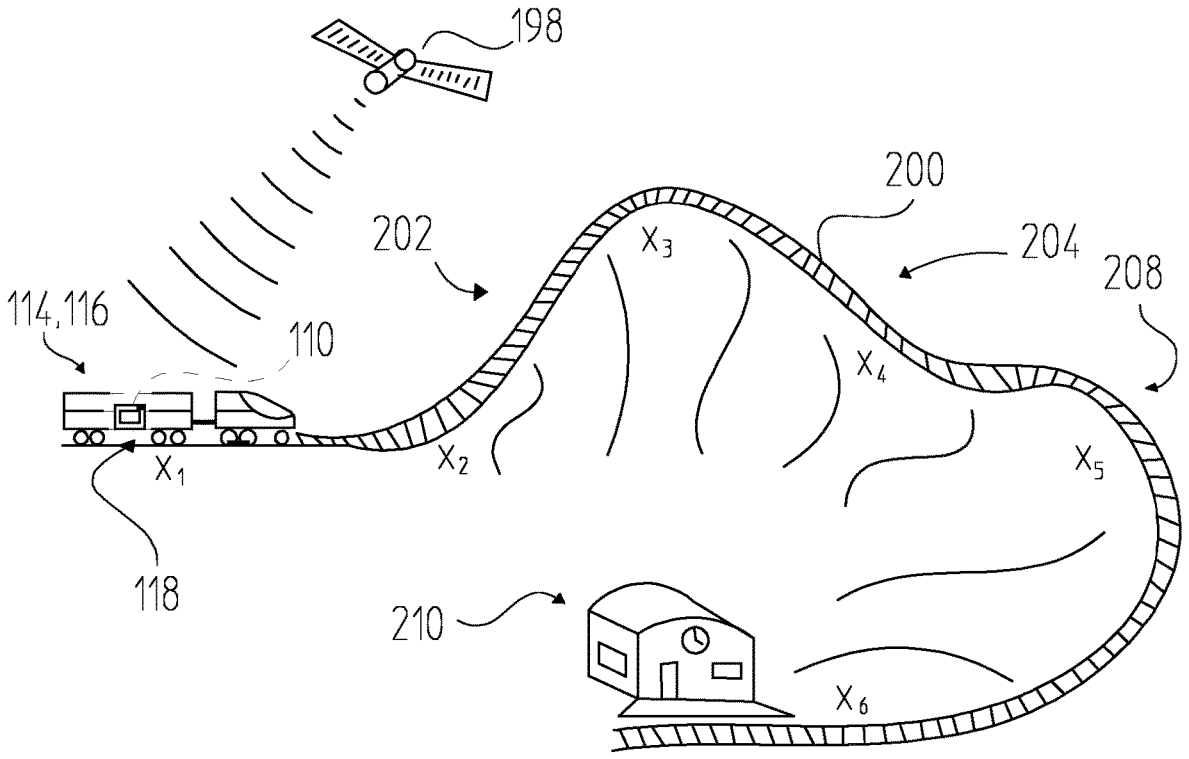
FIG. 2 shows an exemplary embodiment of a means of transport in the form of a train.

In FIG. 1, an exemplary embodiment of a dishwasher 110 according to the invention is shown in a sectional representation from the side. The dishwasher 110 serves for cleaning items to be cleaned 112, for example in the form of dishes. The dishwasher 110 is intended for use in a means of transport 114, which by way of example is shown in a schematic representation in FIG. 2 as a train 116 or, more specifically, as a dining car 118 or rail lounge car of a train 116. In the text which follows, the two figures are explained together.

In the exemplary embodiment shown, the dishwasher 110 comprises a cleaning chamber 122 enclosed by at least one housing 120. The items to be cleaned 112 may be kept in this cleaning chamber 122, in particular in a stationary state, for example by means of one or more holding devices 124, for example one or more dish racks. In the cleaning chamber 122, at least one cleaning fluid 126 can be applied to the items to be cleaned 112 from at least one washing tank 128. For the purpose of this applying, the dishwasher 110 comprises for example an application device 130. This application device 130 may for example comprise a washing line 132, which is connected to the washing tank 128 and in which for example a circulating pump 134 is provided. The application device 130 also comprises by way of example above and below the items to be cleaned 112 nozzle arms 136, which may also be referred to as washing nozzle arms. By way of these nozzle arms 136, which may for example be pivotably mounted, cleaning fluid 126 from the washing tank 128 can be applied to the items to be cleaned 112, for example in circulating mode. After application has taken place and/or at the end of an operating period, the cleaning fluid 126 may be discharged into a drain 142, for example by way of at least one drain line 138 and optionally at least one drain pump 140. For controlling the temperature of the cleaning fluid 126, at least one heating device 144, also referred to as the washing tank heater, may for example be provided in the washing tank 128.

The dishwasher 110 may comprise one or more application devices. Thus, in addition to the application device 130 described, which may also be referred to as the washing system, the dishwasher 110 may have at least one rinsing system 146, which may also be referred to as the final-rinsing system. The rinsing system 146 may for example have at least one rinsing tank 148, which may likewise have for example at least one heating device 150 and which may be configured for example as a boiler. Furthermore, the rinsing system 146 may have at least one rinsing line 152, through which cleaning fluid in the form of rinsing fluid can be passed by means of at least one rinsing pump 154 to rinsing nozzle arms 156. These may for example be formed separately from the nozzle arms 136 of the washing system and may for example once again be arranged above and below the items to be cleaned 112. The rinsing tank 148 may for example be filled with fresh water and/or some other type of cleaning liquid by way of at least one fresh-water line 158, optionally with at least one valve 160.

The dishwasher 110 may for example be configured as a batch dishwasher 162. Thus, for example, the cleaning chamber 122 may be loaded with the items to be cleaned 112 by way of at least one door 164, for example a front flap. Subsequently, a cleaning program, which for example can be selected from a list and is for example controlled in its sequence by a controller 166 of the dishwasher, may be started. Thus, whether in the case of a configuration as a batch dishwasher 162 or else in some other configuration, generally the controller 166 may be designed to adjust operating parameters of the dishwasher 110 in order to act on functional elements, such as for example the pumps 134, 140 or 154, or in order to activate valves such as for example the valve 160. In a program sequence, for example a cleaning program may be carried out, with preferably at least two program steps, for example first a washing step, in which cleaning fluid 126 in the form of washing fluid is applied to the items to be cleaned 112, and subsequently for example at least one rinsing step, in which rinsing fluid from the rinsing tank 148 is applied to the items to be cleaned 112. While the washing step may for example take place in circulating mode, the rinsing step may be carried out for example in the form of once-only application. Subsequently, for example, at least one drying step may also be carried out.

As can be seen in FIG. 1, the washing tank 128 is arranged for example on the bottom of the cleaning chamber 122. Thus, the washing tank 128 may for example take up the entire bottom region of the cleaning chamber 122, or for example only a partial region of this bottom, for example a depression tapering in the form of a funnel in the bottom of the cleaning chamber 122. Generally, however, in most cases the washing tank 128 is open toward the cleaning chamber 122, so that cleaning fluid 126 can flow off from the items to be cleaned 112 directly or indirectly into the washing tank 128. When used in the means of transport 114, for example according to FIG. 2, there is however in this case often the difficulty that, in various transporting situations, the dishwasher 110 is tilted greatly from the horizontal and/or that the cleaning fluid 126 in the washing tank 128 is subjected to strong accelerations, and consequently generally a liquid level 168 of the cleaning fluid 126 can become tilted with respect to a plane of the dishwasher 110, for example a base plane denoted in FIG. 1 by way of example by the designation 170. For example, this may be a plane on which the dishwasher 110 is set up and in relation to which the liquid level 168 is aligned parallel in a non-tilted state of rest of the dishwasher 110 and/or of the means of transport 114. This changing of the tilting of the liquid level 168 of the cleaning fluid 126 with respect to the base plane 170 may however cause the liquid level 168 to rise above a tank limitation at certain points, for example when cornering particularly sharply, in the case of particularly strong accelerations, braking maneuvers, ascending or descending procedures, or else when there are fluctuations of the dishwasher 110, such as for example under heavy swell.

In order to avoid these problems in general, the dishwasher 110 is designed to make a filling level of the washing tank 128 with the cleaning fluid 126 variable. In particular, for this purpose the dishwasher 110 may for example have at least one level sensor 172, which senses an actual level of the cleaning fluid 126 in the washing tank 128 and provides information concerning the level to the controller 166, for example by way of a sensor line that is not shown or else wirelessly at least one sensor. Thus, for example, the filling level may be lowered, in that cleaning fluid 126 is discharged into the drain 142 by way of the drain pump 140. Alternatively or additionally, however, at least one equalizing tank 174 may also be provided, and may be connected for example to the washing tank 128 by way of at least one equalizing line 176 and optionally by way of at least one equalizing pump 178 and/or by way of at least one valve. For the purpose of lowering the level in the washing tank 128, the equalizing pump 178 and/or the drain pump 140 may be activated, for example by means of the controller 166 and/or by means of a feedback controller 180 that is entirely or partially identical to the controller 166 or is formed separately from it, in such a way that cleaning fluid 126 is transferred from the washing tank 128 into the equalizing tank 174 and/or into the drain 142. Conversely, for the purpose of raising the level in the washing tank 128, the equalizing pump 178 may be activated, for example by means of the controller 166 and/or the feedback controller 180, in such a way that cleaning fluid is transferred from the equalizing tank 174 into the washing tank 128. Alternatively or additionally, however, for example a valve 182 of a supply line 184, for example a hot water supply, may also be activated, so that alternatively or additionally the washing tank 128 may also be fed with other cleaning fluid than cleaning fluid from the equalizing tank 174 and the level thereby raised. The changing of the level of the cleaning fluid 126 in the washing tank 128 may take place in a controlled manner on an open-loop basis or else on a closed-loop basis, in particular by means of the feedback controller 180.

The dishwasher 110 is designed in particular to control the filling level of the washing tank 128 with the cleaning fluid 126 to a variably adjustable target level. As stated above, this controlling may take place in particular by means of the feedback controller 180, which may be entirely or partially configured in software or else entirely or partially configured as hardware. The feedback controller 180 may be entirely or partially formed separately from the controller 166 or may also be entirely or partially integrated in the controller 166.

The dishwasher 110 also comprises at least one receiving device 186 for receiving at least one item of spatial information concerning the dishwasher 110 and optionally the means of transport 114. This receiving device 186 may be of a one-part form or, as shown in FIG. 1, also of a multi-part form. Furthermore, the receiving device 186 may be entirely or partially formed separately from the controller 166 or may also be entirely or partially integrated in the controller 166. The spatial information may for example comprise at least one item of information concerning how the dishwasher 110 is currently or in a future time interval tilted, accelerated, subjected to fluctuations or where the dishwasher 110 is currently located and/or where the dishwasher 110 will be located in a future time interval. The receiving device 186 may for example have at least one interface 188 for receiving the spatial information, for example an LAN or WLAN interface. Alternatively or additionally, the receiving device 186 may also for example comprise at least one sensor 190 for sensing the at least one item of spatial information. Thus, the sensor 190 may for example have at least one tilt sensor 192 and/or at least one acceleration sensor 194, for example in order to sense at least one current spatial orientation of the dishwasher 110 and/or at least one current acceleration of the dishwasher 110. These may form the items of spatial information or may also be included as part of the spatial information. Alternatively or additionally, the receiving device 186, in particular the sensor 190, may also for example have at least one GPS sensor 196, also referred to as a GPS receiver, for example in order to obtain or generate an item of information concerning a location of the dishwasher 110 and/or of the means of transport 114, an item of topographical information or else an item of information concerning a speed of the dishwasher 110 and/or of the means of transport 114. Also this information may, alternatively or additionally, form the spatial information or else be included as part of the spatial information.

The controller 166 may for example comprise at least one data processing device, for example at least one processor and/or at least one integrated circuit, for example at least one application-specific integrated circuit (ASIC). The controller 166 is programmed to choose the target level in the washing tank 128 in accordance with the spatial information. Thus, an algorithm which calculates or selects the target level while taking into account the spatial information may for example be stored in the controller 166. For example, one or more lists may be used for this. For example, specific tilts of the dishwasher 110 may be assigned specific levels. Thus, for example, in the case of a horizontal alignment of the dishwasher 110, a maximum target level may be set, for example with a tolerance of ±5° or another tolerance range. If, by contrast, it is found that the dishwasher 110 deviates from a horizontal orientation by an angle of 5-10°, for example a second-highest target level may be set. If it is found that the dishwasher 110 is oriented at an angle of 10-15° in relation to the horizontal, a third-highest target level may be set. This schema may be varied as desired. Analogous schemas may for example also be set for acceleration values.

The location of the means of transport 114 and/or of the dishwasher 110 and/or a speed of the same may also be included in the choice of the target level by way of the spatial information. This is explained by way of example on the basis of the example of FIG. 2. Thus, for example, the spatial information may include information concerning a location of the means of transport 114 and/or of the dishwasher 110 and/or a speed of the same in various ways. For example, the GPS sensor 196 may communicate with one or more satellites 198 and thereby obtain coordinates and/or the speed of the means of transport 114 and/or of the dishwasher 110. Alternatively or additionally, however, communication may for example also take place with at least one route network sensor of a railroad route 200, or at least one item of location information may be obtained from a central controller of the means of transport 114, for example by way of the interface 188.

This location information may be used in various ways in order to influence the target level. Thus, at least one digital map, for example at least one route network map, may for example be stored in the controller 166, which may for example also comprise at least one data store 206. This may be for example a topographical map. In this digital map, setpoint values intended for specific regions may for example already be stored. For example, it can be seen in FIG. 1 that, at location $x_1$ there is an upward incline 202 just ahead, which can be detected from the digital map, so that here the target level can already be lowered in order that, when the upward incline 202 is actually reached at the location $x_2$, the target level already lies in the correct region. At the location $x_3$, it can be detected for example that a downhill gradient 204 is just ahead, so that once again a lowering of the target level can take place. At a location $x_4$, it can for example be detected that a bend 208 is just ahead, so that, here too, a lowering of the target level can take place, so that at the location $x_5$ of the bend 208 itself there is already a lowered level. At the location $x_6$, it can for example be detected that a station 210 will soon be approached, and consequently there will soon be a braking operation, so that, here too, the target level can be lowered. Between these particular events, the target level may for example be raised again to a normal value in the meantime in each case.

Optionally, the controller 166 may also be designed to receive at least one control command from the means of transport 114. Thus, for example, at least one control command for a change of direction, an ascent, a descent or else an acceleration or a braking operation may be transmitted to the controller 166, so that also this information can be included in the determination of the target level.

Generally, the controller 166 may also have for example at least one self-learning algorithm, which can for example be correspondingly learned. This algorithm may for example independently, for example on the basis of the level sensor 172 and/or on the basis of further sensors which for example detect unwanted overflowing of the washing tank 128, independently or at least partially independently create a plan for target levels in accordance with the obtained spatial information. This plan may include discrete or else continuous values for target levels. Generally, the controlling of the filling level of the washing tank 128 may take place continuously or else in steps.

Altogether, consequently, while taking into account the at least one item of spatial information, overflowing of the washing tank 128 as a result of transportation-related tilts and/or fluctuations of the dishwasher 110 can be effectively avoided or at least reduced. This reduction may in particular take place completely without any human intervention and automatically.

LIST OF DESIGNATIONS

110 Dishwasher
112 Items to be cleaned
114 Means of transport
116 Train
118 Dining car
120 Housing
122 Cleaning chamber
124 Holding device
126 Cleaning fluid
128 Washing tank
130 Application device
132 Washing line
134 Circulating pump
136 Nozzle arms
138 Drain line
140 Drain pump
142 Drain
144 Heating device
146 Rinsing system
148 Rinsing tank
150 Heating device
152 Rinsing line
154 Rinsing pump
156 Rinsing nozzle arms
158 Fresh-water line
160 Valve
162 Batch dishwasher
164 Door
166 Controller
168 Liquid level
170 Base plane
172 Level sensor
174 Equalizing tank
176 Equalizing line
178 Equalizing pump
180 Feedback controller
182 Valve
184 Supply line
186 Receiving device
188 Interface
190 Sensor
192 Tilt sensor
194 Acceleration sensor
196 GPS sensor
198 Satellite
200 Railroad route
202 Upward incline
204 Downhill gradient
206 Data store
208 Bend
210 Station

The invention claimed is:

1. A dishwasher for use in a means of transport, comprising:

a) at least one cleaning chamber for receiving items to be cleaned;

b) at least one application device for applying at least one cleaning fluid to the items to be cleaned in the at least one cleaning chamber;

c) at least one washing tank for receiving the at least one cleaning fluid, the dishwasher being designed to control a filling level of the at least one washing tank with the at least one cleaning fluid to a variably adjustable target level;

d) at least one receiving device for receiving at least one item of spatial information concerning the dishwasher;

e) at least one controller, the at least one controller being programmed to determine the target level in accordance with the at least one item of spatial information, wherein the at least one controller is programmed to adjust the target level to at least two different values;

wherein the at least one controller is programmed to replenish the at least one washing tank with the at least one cleaning fluid when falling below the target level; and wherein the at least one controller is programmed to let out the at least one cleaning fluid when going above the target level.

2. The dishwasher as claimed in claim 1, wherein the at least one item of spatial information has at least one item of information selected from the group consisting of: an item of location information concerning a location of the dishwasher; an item of position information concerning a spatial alignment of the dishwasher; an item of movement information concerning a movement of the dishwasher; an item of acceleration information concerning an acceleration of the dishwasher; an item of topographical information concerning a topography of the location of the dishwasher; an item of change information concerning a change to be expected of at least one item of information selected from the group consisting of the item of location information, the item of position information, the item of movement information, the item of acceleration information and the item of topographical information.

3. The dishwasher as claimed in claim 1, wherein the at least one controller is programmed to convert the at least one item of spatial information into the target level by means of at least one conversion.

4. The dishwasher as claimed in claim 1, wherein the at least one receiving device has at least one electronic interface for receiving the at least one item of spatial information.

5. The dishwasher as claimed in claim 1, wherein the at least one receiving device comprises at least one sensor for sensing the at least one item of spatial information.

6. The dishwasher as claimed in claim 5, wherein the least one sensor is selected from the group consisting of: a GPS sensor; a tilt sensor; an acceleration sensor; a pressure sensor; a triangulation sensor.

7. The dishwasher as claimed in claim 1, wherein the at least one controller has at least one digitized map with a plurality of possible locations at which the dishwasher may be located.

8. The dishwasher as claimed in claim 1, wherein the dishwasher also has at least one equalizing tank, the at least one controller being programmed to transfer part of the at least one cleaning fluid from the at least one washing tank into the at least one equalizing tank when there is a lowering of the target level and/or the at least one controller also being programmed to transfer part of the at least one cleaning fluid from the at least one equalizing tank into the at least one washing tank when there is a raising of the target level.

9. The dishwasher as claimed in claim 1, wherein the dishwasher is designed as a batch dishwasher, the at least one controller being programmed to perform at least one cleaning program, the at least one cleaning program comprising at least one washing step in which the, at least one, cleaning fluid from the at least one washing tank is applied to the items to be cleaned, the at least one controller being programmed to change the target level in the at least one washing tank in accordance with the at least one item of spatial information during the at least one washing step.

10. The dishwasher as claimed in claim 1, wherein the at least one receiving device is also designed to receive at least one item of type information concerning a type of the means of transport, the at least one controller being programmed to take the at least one item of type information into account when determining the target level.

11. The dishwasher as claimed in claim 1, wherein the at least one receiving device is also designed to receive at least one control signal from the means of transport, the at least one controller being programmed to take the at least one control signal into account when determining the target level.

12. A means of transport, comprising at least one dishwasher as claimed in claim 1.

13. A method for operating the dishwasher as claimed in claim 1 in the means of transport, comprising the following steps:

i) receiving the at least one item of spatial information concerning the dishwasher by means of the at least one receiving device;

ii) determining the target level in accordance with the at least one item of spatial information by means of the at least one controller; and iii) controlling the filling level of the at least one washing tank with the at least one cleaning fluid to the target level corresponding to the at least one item of spatial information.

14. A method of washing dishes in a means of transport, the method comprising using the dishwasher as claimed in claim 1.

15. The method according to claim 14, wherein the means of transport is selected from the group consisting of: a railroad train; an overland bus; a ship; an aircraft; a mobile field kitchen.

16. The dishwasher as claimed in claim 3, wherein the at least one conversion process includes application of an assignment algorithm, the at least one item of spatial information being assigned a corresponding target level by means of the assignment algorithm.

17. The dishwasher as claimed in claim 3, wherein the at least one conversion process includes referral to an electronic table, in which items of spatial information are respectively assigned corresponding target-level values.

18. The dishwasher as claimed in claim 3, wherein the at least one conversion process includes a self-learning algorithm using at least one neural network, in which items of spatial information are respectively assigned corresponding target-level values, the at least one neural network is configured to learn the corresponding target-level values during runs of the means of transport.

19. A dishwasher for use in a means of transport, comprising:

a) at least one cleaning chamber for receiving items to be cleaned;

b) at least one application device for applying at least one cleaning fluid to the items to be cleaned in the at least one cleaning chamber;

c) at least one washing tank for receiving the at least one cleaning fluid, the dishwasher being designed to control a filling level of the at least one washing tank with the at least one cleaning fluid to a variably adjustable target level;

d) at least one receiving device for receiving at least one item of spatial information concerning the dishwasher; and e) at least one controller, the at least one controller being programmed to determine the target level in accordance with the at least one item of spatial information, wherein the at least one controller has at least one digitized map with a plurality of possible locations at which the dishwasher may be located.

20. A dishwasher for use in a means of transport, comprising:

a) at least one cleaning chamber for receiving items to be cleaned;

b) at least one application device for applying at least one cleaning fluid to the items to be cleaned in the at least one cleaning chamber;

c) at least one washing tank for receiving the at least one cleaning fluid, the dishwasher being designed to control a filling level of the at least one washing tank with the at least one cleaning fluid to a variably adjustable target level;

d) at least one receiving device for receiving at least one item of spatial information concerning the dishwasher; and e) at least one controller, the at least one controller being programmed to determine the target level in accordance with the at least one item of spatial information; and wherein the dishwasher also has at least one equalizing tank, the at least one controller being programmed to transfer part of the at least one cleaning fluid from the at least one washing tank into the at least one equalizing tank when there is a lowering of the target level and/or the at least one controller also being programmed to transfer part of the at least one cleaning fluid from the at least one equalizing tank into the at least one washing tank when there is a raising of the target level.

21. A dishwasher for use in a means of transport, comprising:

a) at least one cleaning chamber for receiving items to be cleaned;

b) at least one application device for applying at least one cleaning fluid to the items to be cleaned in the at least one cleaning chamber;

c) at least one washing tank for receiving the at least one cleaning fluid, the dishwasher being designed to control a filling level of the at least one washing tank with the at least one cleaning fluid to a variably adjustable target level;

d) at least one receiving device for receiving at least one item of spatial information concerning the dishwasher;

e) at least one controller, the at least one controller being programmed to determine the target level in accordance with the at least one item of spatial information; and wherein the at least one receiving device is also designed to receive at least one item of type information concerning a type of the means of transport, the at least one controller being programmed to take the at least one item of type information into account when determining the target level.

22. A dishwasher for use in a means of transport, comprising:

a) at least one cleaning chamber for receiving items to be cleaned;

b) at least one application device for applying at least one cleaning fluid to the items to be cleaned in the at least one cleaning chamber;

c) at least one washing tank for receiving the at least one cleaning fluid, the dishwasher being designed to control a filling level of the at least one washing tank with the at least one cleaning fluid to a variably adjustable target level;

d) at least one receiving device for receiving at least one item of spatial information concerning the dishwasher;

e) at least one controller, the at least one controller being programmed to determine the target level in accordance with the at least one item of spatial information; and wherein the at least one receiving device is also designed to receive at least one control signal from the means of transport, the at least one controller being programmed to take the at least one control signal into account when determining the target level.

23. A dishwasher for use in a means of transport, comprising:

a) at least one cleaning chamber for receiving items to be cleaned;

b) at least one application device for applying at least one cleaning fluid to the items to be cleaned in the at least one cleaning chamber;

c) at least one washing tank for receiving the at least one cleaning fluid, the dishwasher being designed to control a filling level of the at least one washing tank with the at least one cleaning fluid to a variably adjustable target level;

d) at least one receiving device for receiving at least one item of spatial information concerning the dishwasher;

e) at least one controller, the at least one controller being programmed to determine the target level in accordance with the at least one item of spatial information, wherein the at least one controller is programmed to adjust the target level to at least two different values; and wherein the at least one controller is programmed to choose the at least two different values based on the at least one item of spatial information.

24. A dishwasher for use in a means of transport, comprising:

a) at least one cleaning chamber for receiving items to be cleaned;

b) at least one application device for applying at least one cleaning fluid to the items to be cleaned in the at least one cleaning chamber;

c) at least one washing tank for receiving the at least one cleaning fluid, the dishwasher being designed to control a filling level of the at least one washing tank with the at least one cleaning fluid to a variably adjustable target level;

d) at least one receiving device for receiving at least one item of spatial information concerning the dishwasher; and e) at least one controller, the at least one controller being programmed to determine the target level in accordance with the at least one item of spatial information, wherein the at least one controller is programmed to adjust the target level to at least three different values.

* * * * *